US008601690B2

(12) United States Patent
Ebisu et al.

(10) Patent No.: US 8,601,690 B2
(45) Date of Patent: Dec. 10, 2013

(54) METHOD FOR MANUFACTURING A VARIABLE CAPACITY EXHAUST GAS TURBINE

(75) Inventors: Motoki Ebisu, Sagamihara (JP); Shingo Yokota, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 655 days.

(21) Appl. No.: 12/811,530

(22) PCT Filed: Aug. 17, 2009

(86) PCT No.: PCT/JP2009/064400
§ 371 (c)(1),
(2), (4) Date: Jul. 12, 2010

(87) PCT Pub. No.: WO2010/024145
PCT Pub. Date: Mar. 4, 2010

(65) Prior Publication Data

US 2011/0041333 A1 Feb. 24, 2011

(30) Foreign Application Priority Data

Aug. 28, 2008 (JP) ..... 2008-220363

(51) Int. Cl.
*B21K 25/00* (2006.01)
*B23P 15/04* (2006.01)

(52) U.S. Cl.
USPC ..... 29/889.2; 29/889.21; 60/602; 60/605.1

(58) Field of Classification Search
USPC ..... 29/889.2, 0.21, 0.22, 889.3; 60/602; 415/148, 150–151
See application file for complete search history.

(56) References Cited

U.S. PATENT DOCUMENTS 2,944,786 A * 7/1960 Angell et al. ..... 415/155
4,177,005 A * 12/1979 Bozung et al. ..... 415/128
(Continued)

FOREIGN PATENT DOCUMENTS

EP 1 462 628 A1 9/2004
EP 1462628 A1 9/2004
(Continued)

OTHER PUBLICATIONS

Chinese Office Action dated Sep. 5, 2011.
Korean Office Action dated Dec. 15, 2011.

*Primary Examiner* — Alexander P Taousakis
(74) *Attorney, Agent, or Firm* — Birch, Stewart, Kolasch & Birch, LLP

(57) ABSTRACT

A manufacturing method for a variable capacity exhaust gas turbine whereby, a gap in a tongue section allowing exhaust gas to flow into an inner circumferential scroll section can be formed at a minimum, and a cover section near a ring can be mounted with high precision. In the method: exhaust gas turbine component members comprise a cover section and a reduced-diameter plate section extending the inner diameter side towards the shaft following the gap between a bearing housing and the turbine rotor; the cover section and the reduced-diameter plate section are integrally formed; a molded surface of the cover section is protruded to form a protrusion corresponding to the tongue section and formed in an intake equivalent portion of the inner circumferential scroll section of the cover section; and the protrusion undergoes cutting, and a cut surface and the tongue section are assembled maintaining the gap.

3 Claims, 5 Drawing Sheets

(56) References Cited

U.S. PATENT DOCUMENTS

| | | | | |
|---|---|---|---|---|
| 4,473,931 | A * | 10/1984 | Komatsu | 29/889.2 |
| 4,761,122 | A * | 8/1988 | Matsugi et al. | 418/55.1 |
| 6,073,447 | A | 6/2000 | Kawakami et al. | |
| 7,574,862 | B2 * | 8/2009 | Giselmo et al. | 60/612 |
| 2011/0008162 | A1 * | 1/2011 | Yokoyama et al. | 415/204 |

FOREIGN PATENT DOCUMENTS

| | | | |
|---|---|---|---|
| EP | 1 462 628 | B1 | 7/2006 |
| JP | 10-8977 | A | 1/1998 |
| JP | 2003-314290 | A | 11/2003 |
| JP | 2004-300966 | A | 10/2004 |
| JP | 3956884 | B2 | 8/2007 |

* cited by examiner

Conventional Art

METHOD FOR MANUFACTURING A VARIABLE CAPACITY EXHAUST GAS TURBINE

BACKGROUND OF THE INVENTION

1. Field of the Invention

The present invention relates to a method for manufacturing a variable capacity exhaust gas turbine in an exhaust gas turbocharger used for the internal combustion engine of a comparably small or medium size; whereby, the exhaust gas emitted from the engine (internal combustion) streams through a scroll passage for feeding the exhaust gas from an exhaust gas inlet to a turbine rotor, the cross-section area of the scroll passage comprising an outer scroll passage and an inner scroll passage is gradually reduced along the gas stream direction; thereby, the scroll passage is partitioned into the outer scroll passage that is placed at an outer side in the direction of the radius of the turbine rotor and the inner scroll passage that is placed at an inner side in the direction of the radius of the turbine rotor, wherein a plurality of insert vanes is provided between the outer scroll passage and the inner scroll passage so that the exhaust gas streams into the inner scroll passage not only directly from the exhaust gas inlet but also via the outer scroll passage; and, a cover that demarcates the scroll passage is provided with the insert vanes that protrude from the body surface of the cover toward the scroll passage, the insert vanes being arranged in a row along a boundary wall between the outer scroll passage and the inner scroll passage.

2. Background Art

FIG. 4(A) shows the main feature as to a cross section of a variable capacity exhaust gas turbine that is disclosed in Patent Reference 1 (JP3956884), the cross section being orthogonal to the axis of the rotation as to the gas turbine; FIG. 4(B) shows D-D cross-section in FIG. 4(A); FIG. 5 shows Y-Y cross-section in FIG. 4(A).

The variable capacity exhaust gas turbine as described above houses a turbine rotor 10 driven by the exhaust gas, in the middle part (around the rotation axis 100*a*) of a turbine housing of the gas turbine.

The turbine housing 01 comprises an exhaust gas inlet 20 and an exhaust gas outlet 20*a*; the turbine housing 01 further comprises a scroll passage through which the exhaust gas flows from an exhaust gas inlet 20 toward a turbine rotor 10 that is positioned at an inner (central) part of the housing, the cross-section of the scroll passage gradually reducing along the gas stream direction.

The scroll passage is divided into two parts; namely, the scroll passage comprises an inner scroll passage 2 and an outer scroll passage 1; between the inner scroll passage 2 and the outer scroll passage 1, a plurality of insert vanes 6*a* are installed in a row as the vanes are arranged along a boundary (partition) wall 2*a* of the scroll passage 12, in a hoop direction (a spiral direction) around the center axis of the turbine; the insert vanes 6*a* as well as the boundary wall play the role in partitioning the scroll passage. Further, an exhaust gas passage 6*b* is formed between each vane and the adjacent vane thereof.

Moreover, the multiple insert vanes 6*a* are provided on a cover 6 as shown in FIGS. 4 and 5; the vanes 6*a* are installed upright from the main body of the cover 6 along the hoop direction around the center axis of the turbine. As shown in FIG. 5, the insert vanes installed in a row separate the scroll passage 12 into the outer scroll passage and the inner scroll passage.

Further, according to Patent Reference 1 as shown in FIG. 5, a heat insulation plate 6*c* is integral with the cover 6; the integrated body (member) is attached between a bearing part is (of the turbine housing 01) and a bearing housing 11; namely, the integrated body is sandwiched by the turbine housing 01 and the bearing housing 11, in the neighborhood part of the outer periphery part as to the cover 6, in other words, in the neighborhood of a circular periphery 8 of the cover 6; thereby, a plurality of bolts 29 fastens the bearing housing 11 toward the turbine housing 01.

Further, as shown in FIG. 4(A), a tongue 5 is formed near the gas inlet area of the inner scroll passage 2 along the exhaust gas stream so that the exhaust gas is smoothly guided and supplied into the scroll passage 2.

Further, a control valve 4 is provided so as to control the exhaust gas flow rates into the inner scroll passage 2 as well as into the outer scroll passage 1, in a manner that the control valve 4 comes in contact with a periphery wall 4*a* as well as leaves the periphery wall 4*a*, the periphery wall 4*a* being formed in the turbine housing 01.

In other words, the outer scroll passage 1 is closed during the engine low-speed operation so that the control valve 4 comes into contact with the periphery wall 4*a* and closes (the inlet of) the outer scroll passage 1; thus, the engine exhaust gas flows only into the inner scroll passage 2 along the direction of the curved arrow $U_2$ as shown in FIG. 4.

On the other hand, the outer scroll passage 1 is opened during the engine high-speed operation so that the control valve 4 leaves the periphery wall 4*a* and opens (the inlet of) the outer scroll passage 1; thus, the engine exhaust gas flows not only into the inner scroll passage 2 along the direction of the curved arrow $U_2$ but also into the outer scroll passage 1 along the direction of the curved arrow $U_1$ as shown in FIG. 4; further, the exhaust gas that flows into the outer scroll 1 flows into the inner scroll passage 2 through the exhaust gas passages 6*b* between the insert vanes 6*a* and the adjacent insert vanes 6*a* thereof.

Thus, the exhaust gas flow rate can be changed from the engine low-speed speed operation to the engine high-speed operation, and vice versa, by controlling the control valve 4.

REFERENCES

PATENT REFERENCE 1: JP3956884

SUMMARY OF THE INVENTION

In manufacturing the variable capacity exhaust gas turbine (as a finished product namely a complete product) that is shown in FIGS. 4 and 5 according to Patent Reference 1, by use of any one of the (part) forming processes such as casting, injection molding or cold forging as well as by use of a (part) machining process as to the part, there arise the subjects to be solved as follows.

(1) As shown in FIG. 4(A) and in FIG. 4(B) that shows D-D cross-section in FIG. 4(A), the tongue 5 is formed near the gas inlet area of the inner scroll passage 2 along the exhaust gas stream so that the exhaust gas is smoothly guided and supplied into the scroll passage 2.

In fear of the contact (interference) between the mutually facing members in being assembled as well as in consideration of the manufacturing tolerance, a considerably large clearance 19*a* (a dimension $S_1$) is provided between the tongue 5 that is formed in the turbine housing 01 and a body surface 6*p* that is the surface of the main body of the cover 6, as the body surface 6*p* is a raw work-piece surface or both of the body surface 6*p* and the tongue 5 are raw work-piece surfaces.

However, the smaller the clearance, the better the turbine efficiency, as for the clearance 19*a* between the tongue 5 and the body surface 6*p*; nevertheless, a considerably large clearance 19*a* has to be practically provided; thus, a problem arises that the exhaust gas leakage increases through the clearance 19*a* and the turbine efficiency decreases.

(2) In addition, as shown in FIG. 5, the cover 6 (together with the heat insulation plate) is attached between a bearing part is of the turbine housing 01 and a bearing housing 11; namely, the cover is sandwiched by the turbine housing 01 and the bearing housing 11, in the neighborhood part of the outer periphery part as to the cover 6, in other words, in the neighborhood of the circular periphery 8 of the cover 6; thereby, a plurality of bolts 29 fastens the bearing housing 11 toward the turbine housing 01. In a structure like this, however, high accuracy as to the installation arrangement of the cover cannot be expected; further, it is also a problem that a countermeasure to cope with the thermal expansion as to the heat insulation plate 6*c* is not incorporated.

In view of the subjects to be overcome as described above, the present invention aims at providing a manufacturing method for manufacturing a variable capacity exhaust gas turbine, the gas turbine comprising a part that is made by row material (work-piece) forming process such as metal casting and is machined to form a completed part as a finished product, whereby the clearance around the tongue can be limited to a minimal dimension level, the tongue being provided so that the exhaust gas smoothly flows into the inner scroll passage; and, the present invention aims at providing high accuracy as to the installation arrangement of the cover, the accuracy being related to the installation (fitting arrangement) of the cover that is fitted in the neighborhood of the circular periphery part of the cover.

Means to Solve the Subjects

In order to overcome the problems in the conventional technology as described above, the present invention discloses a manufacturing method for manufacturing a variable capacity exhaust gas turbine, the gas turbine comprising:

a turbine shaft supported by a bearing housing;

a turbine rotor that is fixed to an end of the turbine shaft and rotationally driven by exhaust gas;

an exhaust gas inlet through which the exhaust gas is supplied;

an exhaust gas outlet through which the exhaust gas is discharged; and a turbine housing comprising:

a scroll passage between said exhaust gas inlet and said turbine rotor, the cross-section area of the scroll passage gradually reduces along the direction of the exhaust gas stream, the scroll passage is provided with an inner scroll passage and an outer scroll passage into which the scroll passage is divided along a hoop direction around the turbine rotor, a plurality of insert vanes being provided in a row along the boundary between the inner scroll passage and the outer scroll passage, the row of insert vanes being configured so that the exhaust gas flow directly into the inner scroll passage and the exhaust gas flow into the inner scroll passage via the outer scroll passage are controlled, and a control valve that is arranged at an exhaust gas inlet side as to the outer scroll passage so as to control the exhaust gas flow rate into the inner scroll passage as well as into the outer scroll passage, and an opening end face that faces the bearing housing;

the gas turbine further comprising:

a cover that is arranged at the opening end face of the turbine housing so as to demarcate the inner scroll passage and the outer scroll passage, the insert vanes being provide so as to protrude from the body of the cover toward the side of the exhaust gas passage;

wherein, a radius-reducing plate part is extended so as to form an integrated part together with the cover, thereby the plate thickness is reduced from the outer side to the inner side toward the rotation axis of the turbine rotor, the cover and the radius-reducing plate part being arranged in a gap between the bearing housing and the turbine rotor, along a plane vertical to the rotation axis of the turbine rotor;

the cover and the radius-reducing plate part are formed as an integrated member by means of any one of casting, injection molding, or cold forging;

the raw work-piece surface of the cover is provided with a protrusion part in the raw work-piece manufacturing stage so that the protrusion part protrudes from the raw work-piece surface of the cover, the protrusion part being arranged in response to the arrangement of a tongue that is formed in the neighborhood of the exhaust gas inlet of the inner scroll passage in the turbine housing as a part thereof;

the integrated member as to the cover and the radius-reducing plate part is assembled into the gas turbine after the protrusion part is machined so that an allowable clearance is formed between the tongue and the protrusion part.

A preferable embodiment of the above-disclosure is the manufacturing method for manufacturing a variable capacity exhaust gas turbine, whereby the integrated member as to the cover and the radius-reducing plate part comprises a connection part between the cover and the radius-reducing plate part, the connection part is provided with a circle ringed protrusion toward the bearing housing, the circle ringed protrusion being formed so that the circle ringed protrusion and the integrated member as to the cover and the radius-reducing plate part form an integrated body in and from the stage of raw work-piece forming;

the inner periphery of the circle ringed protrusion is machined in a machining process following to the raw work-piece forming process, so that an outer circle periphery step-surface of the bearing housing is fitted into the inner periphery of the circle ringed protrusion in the stage of the assembling process of the gas turbine, in order that the integrated member as to the cover, the radius-reducing plate part and the connection part is supported by from the bearing housing.

Another preferable embodiment following the above is the manufacturing method for manufacturing a variable capacity exhaust gas turbine, whereby an outer periphery surface that is an outer circumferential circle surface of the cover is machined;

a convex part that is formed around the outer periphery of the cover, in an adjacent neighborhood of the outer periphery surface, thereby convex part sandwiched between the bearing housing and the turbine housing so that the bearing housing and the turbine housing support the cover;

the radius-reducing plate part that is extended from the cover in a gap between the turbine housing and the bearing housing toward the rotation axis of the turbine rotor is placed under a free condition without deformation constraint, so that the thermal expansion of the thickness-reducing plate becomes allowable.

Effect of the Present Invention

According to the disclosure of the present invention, in manufacturing processes including a raw work-piece forming process by use of any one of casting, injection molding or cold forging, as well as, finishing (machining) process to produce a completed assembling part, the exhaust gas turbine is provided with a radius-reducing plate part that is extended so as to form an integrated part together with the cover, thereby the plate thickness reduces from the outer side to the inner side toward the rotation axis of the turbine rotor, the cover and the radius-reducing plate part being arranged in a gap between the bearing housing and the turbine rotor, along a plane vertical to the rotation axis of the turbine rotor;

the cover and the radius-reducing plate part are formed as an integrated member through a raw work-piece forming process;

the raw work-piece surface of the cover is provided with a protrusion part in the raw work-piece manufacturing stage so that the protrusion part protrudes from the raw work-piece surface of the cover, the protrusion part being arranged in response to the arrangement of the tongue that is formed in the exhaust gas passage of the turbine housing;

the integrated member as to the cover and the radius-reducing plate part is assembled into the gas turbine after the protrusion part is machined so that an allowable clearance is formed between the tongue and the protrusion part.

Thus, in response to the tongue formed in the turbine housing, the raw work-piece surface of the cover is provided with a protrusion part in the raw work-piece manufacturing stage so that the protrusion part protrudes from the raw work-piece surface; the integrated member as to the cover and the radius-reducing plate part is assembled into the gas turbine after the protrusion part is machined in the following machining stage so that an allowable clearance is formed between the tongue and the protrusion part. In conclusion, the above-described clearance can be controllably achieved by machining.

Accordingly, a machining process obtains the clearance between the tongue and the cover body surface; therefore, the clearance can be constrained to a minimal level. As a result, the exhaust gas leakage through the clearance can be reduced, and the efficiency of the exhaust gas turbine can be enhanced.

Further, only a part of the raw work-piece surface of the cover is protruded so as to form the protrusion part that is only the machined part; thus, the manufacturing and the (assemble) structure become simple and cost-effective.

According to a preferable embodiment of the present invention, the integrated member as to the cover and the radius-reducing plate part comprises a connection part between the cover and the radius-reducing plate part, the connection part is provided with a circle ringed protrusion toward the bearing housing, the circle ringed protrusion being formed so that the circle ringed protrusion and the integrated member as to the cover and the radius-reducing plate part form an integrated body in and from the stage of raw work-piece forming;

the inner periphery of the circle ringed protrusion is machined in a machining process following to the raw work-piece forming process, so that an outer (circle) periphery step-surface of the bearing housing is fitted into the inner periphery of the circle ringed protrusion in the stage of the assembling process of the gas turbine, in order that the integrated member as to the cover, the radius-reducing plate part and the connection part is (able to be) supported by from the bearing housing.

On the other hand, according to the conventional approach as depicted in FIG. 5 whereby the cover is sandwiched by the turbine housing and the bearing housing, in the neighborhood part of the outer periphery part as to the cover, in other words, in the neighborhood of the circular periphery of the cover; thereby, a plurality of bolts fastens the bearing housing toward the turbine housing. Hence, the fitting of the cover in the present embodiment can be performed with higher accuracy in comparison with the fitting in the conventional approach.

According to another preferable embodiment of the present invention, an outer periphery surface that is an outer circumferential circle surface of the cover is machined;

a convex part that is formed around the outer periphery of the cover, in an adjacent neighborhood of the outer periphery surface, thereby convex part sandwiched between the bearing housing and the turbine housing so that the bearing housing and the turbine housing support the cover;

the radius-reducing plate part that is extended from the cover in a gap between the turbine housing and the bearing housing toward the rotation axis of the turbine rotor is placed under a free condition without deformation constraint, so that the thermal expansion of the radius-reducing plate becomes allowable.

In this way, the outer periphery surface that is an outer circumferential circle surface of the cover is machined in a machining process after the raw work-piece forming process.

Thus, with a configuration as described above, the thermal expansion of the radius-reducing plate part (as a heat insulation plate) becomes permissible so that thermal stress due to thermal deformation constraint is prevented. Consequently, the thermal expansion of the radius-reducing plate part (a radiation-heat insulation plate) can be prevented from being broken.

DETAILED DESCRIPTION OF THE INVENTION

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

Figure 1:
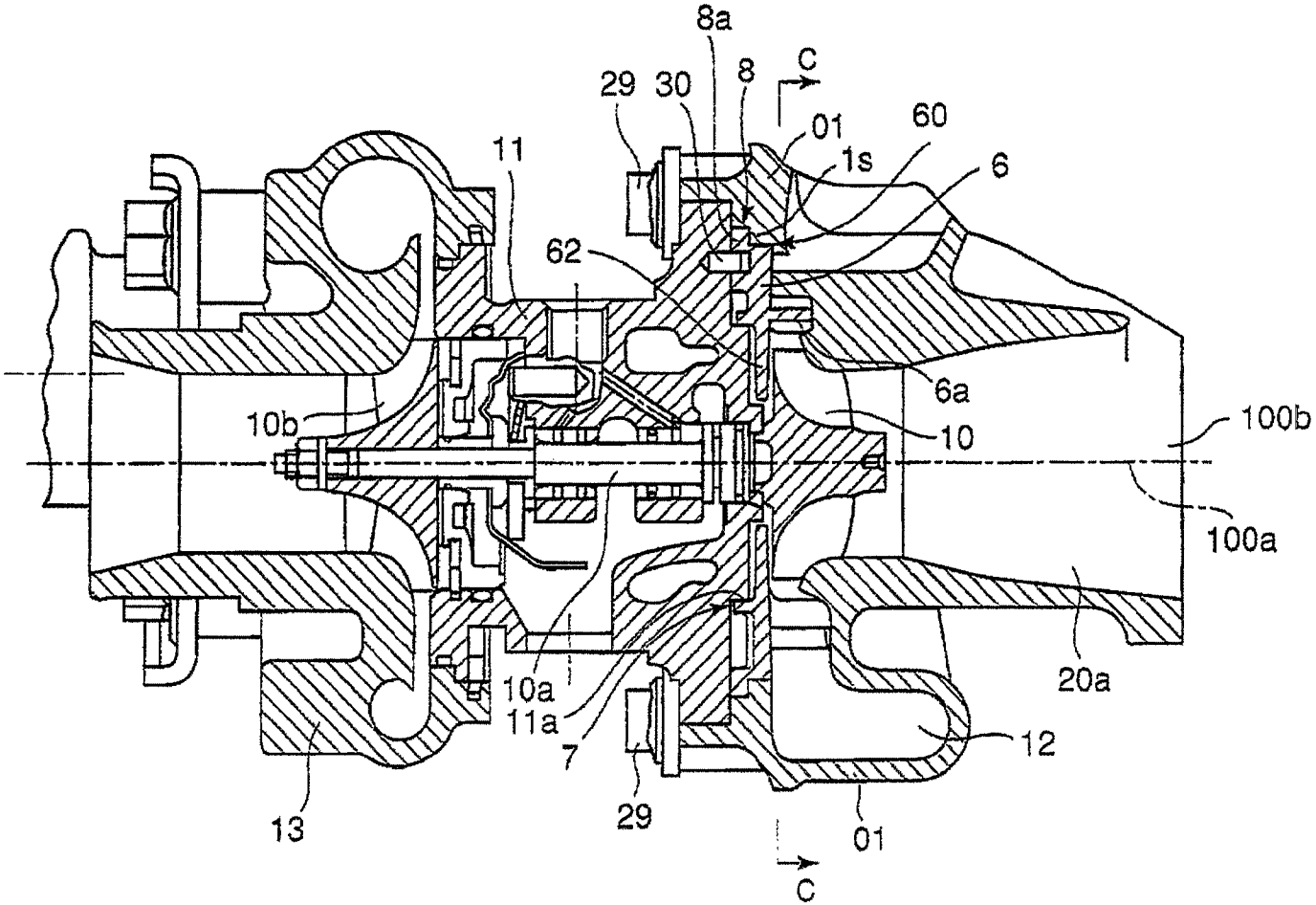
FIG. 1 shows a cross section of a variable capacity exhaust gas turbine according to an embodiment of the present invention, the cross section including a rotation axis of the gas turbine.
Figure 2B:
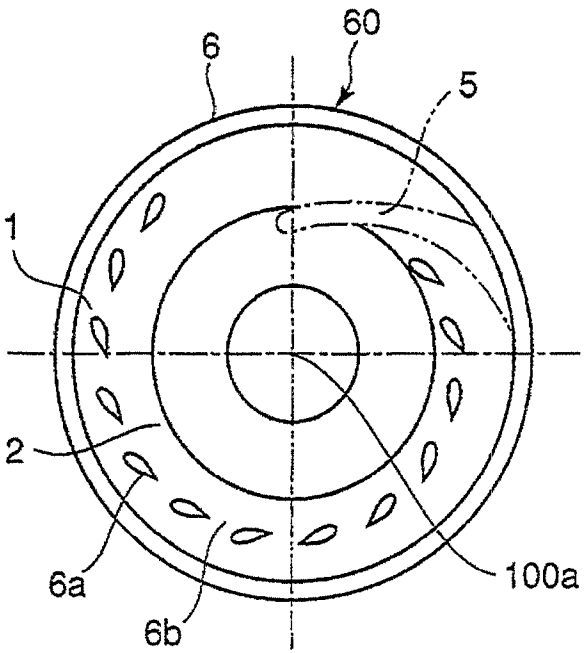
FIG. 2(B) shows A-arrow view as to FIG. 2(A)
Figure 2A:
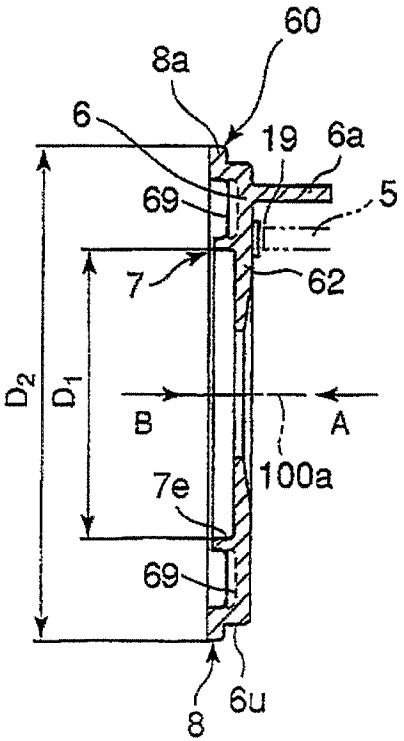
FIG. 2(A) shows a cross section of the cover and a radius-reducing plate part that is integral with the cover in the embodiment as shown in FIG. 1.
Figure 2C:
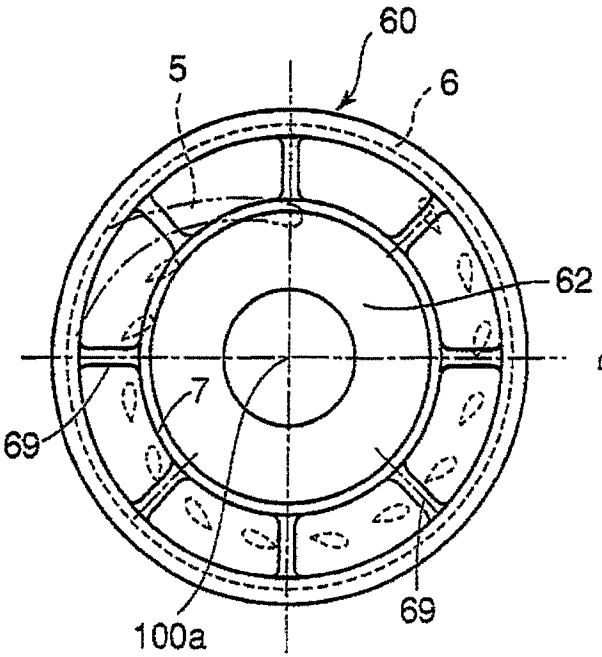
FIG. 2(C) shows B-arrow view as to FIG. 2(A)
Figures 3A, 3B:
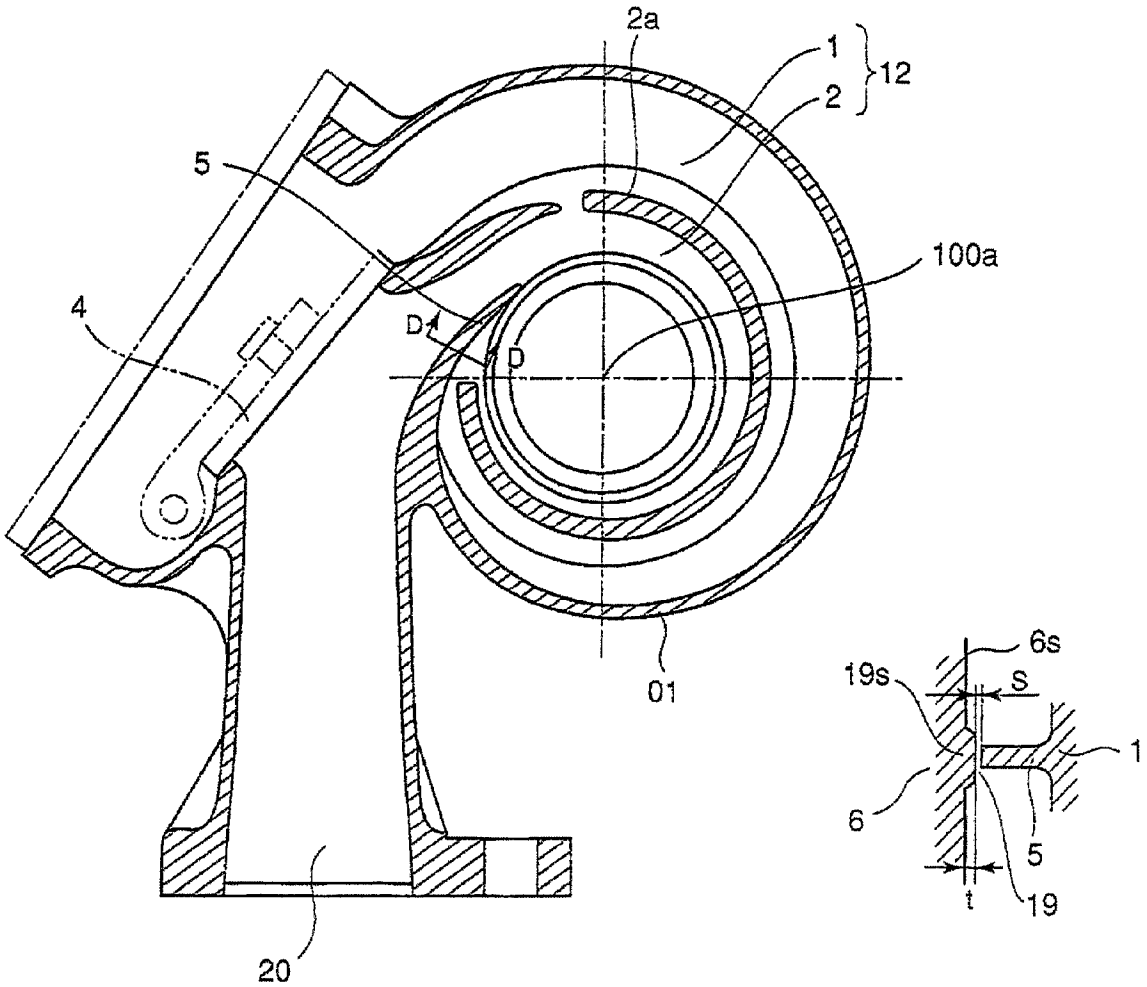
FIG. 3(A) shows C-C cross-section in FIG. 1.
FIG. 3(B) shows D-D cross-section in FIG. 3(A)

FIG. 1 shows a cross section of a variable capacity exhaust gas turbine according to an embodiment of the present invention, the cross section including a rotation axis of the gas turbine; FIG. 2(A) shows a cross section of the cover and the radius-reducing plate part that is integral with the cover in the embodiment as shown in FIG. 1, the radius-reducing plate part (that forms an integrated part together with the cover) in which the plate thickness thereof reduces from the outer side to the inner side toward the rotation axis of the turbine rotor; FIG. 2(B) shows A-arrow view as to FIG. 2(A); FIG. 2(C) shows B-arrow view as to FIG. 2(A); FIG. 3(A) shows C-C cross-section in FIG. 1; FIG. 3(B) shows D-D cross-section in FIG. 3(A).

As shown in FIG. 1, the variable capacity exhaust gas turbine is provided with a turbine rotor 10 that is driven by the exhaust gas so as to rotate around a rotation axis 100*a* located at a middle center in a turbine housing 01; the turbine rotor 10 is connected to a compressor 10*b* housed in a compressor housing 13 directly via a turbine shaft 10*a*.

Further, the compressor housing 13 is connected to the turbine housing 01 via a bearing housing 11.

FIG. 3(A) shows a structure seen in a cutting plane (C-C cross-section in FIG. 1) in relation to the inside of the turbine housing 01 that comprises an exhaust inlet part 20 and an exhaust outlet part 20*a* (as shown in FIG. 1). The turbine housing 01 further comprises a scroll passage 12 in which the cross-section area of the passage forming a passage space from the exhaust inlet 20 to the turbine rotor 10 that forms the inner-side surface of the passage is gradually reduced along the stream direction of the exhaust gas.

The scroll passage 12 is divided into two passages, an inner scroll passage 2 and an outer scroll passage 1 in a radial direction of the turbine rotor. In addition, the numeral 4 denotes a control valve that is explained later.

Figure 4B:
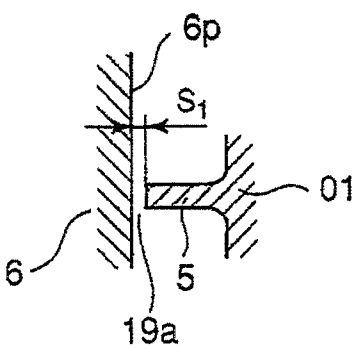
Fig. 4(B) Conventional Art
FIG. 4(B) shows D-D cross-section in FIG. 4(A)
Figure 4A:
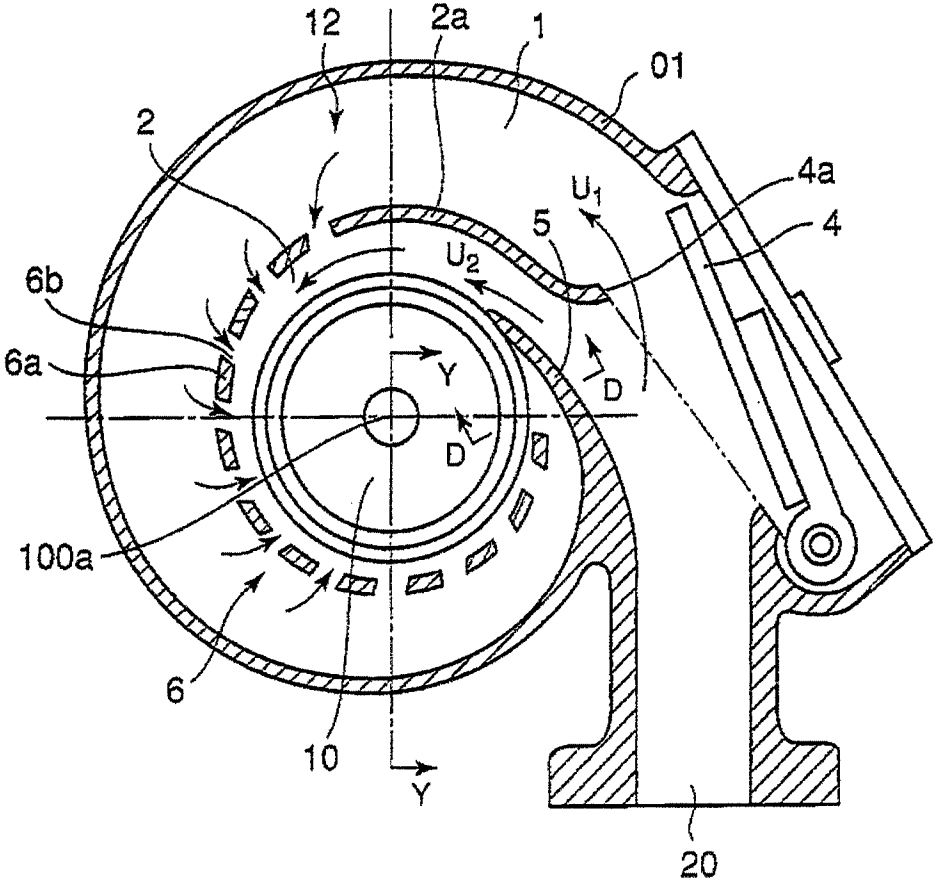
FIG. 4(A) shows a cross section of a variable capacity exhaust gas turbine according to a conventional technology, the cross section being orthogonal to the axis of the rotation as to the gas turbine.
Figure 5:
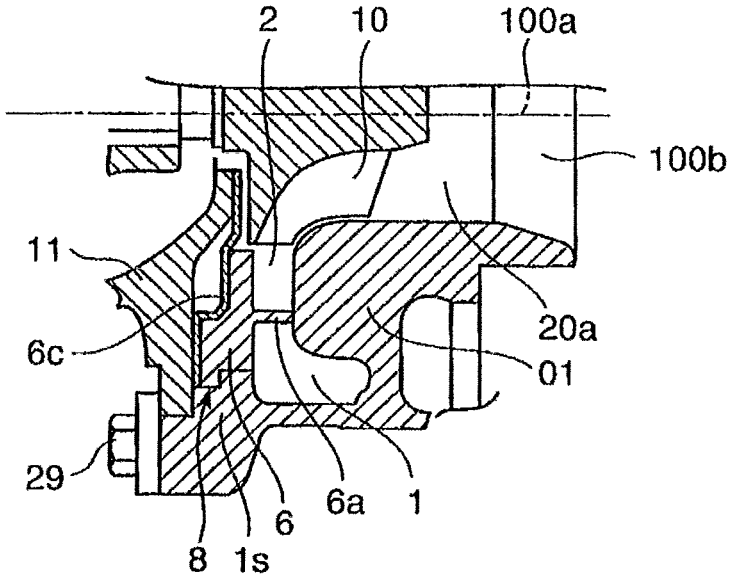
FIG. 5 shows Y-Y cross-section in FIG. 4(A) according to conventional technology.

The basic configuration of the above is the same as the conventional configuration of the conventional art described in FIGS. 4 and 5.

The present invention is peculiarly related to a raw work-piece forming and machining thereof in connection with an insert member 60 that comprises a cover 6 as well as a radius-reducing plate part 62.

As shown in FIG. 1, the insert member 60 comprising the cover and the radius-reducing plate part 62 is provided so that the insert member 60 covers the turbine housing 01 from the side of an end opening face 100*b* of the turbocharger toward the side of the compressor. In addition, the variable capacity exhaust gas turbine as shown in FIG. 1 comprises the exhaust gas outlet part 20*a*, the scroll passage 12, a circle ringed protrusion part 7 which is described later, and a plurality of insert vanes 6*a*.

In the present embodiment, the raw work-piece as to the insert member 60 comprising the cover 6 and the radius-reducing plate part 62 is to be formed by means of precision casting; as a matter of course, the insert member 60 may be formed by means of any one of lost-wax process, metal injection molding, cold forging or the like.

The shape and the configurations as to the insert member 60 are depicted in FIGS. 2(A), 2(B), and 2(C).

As shown in FIG. 3(A), the turbine housing 01 is provided with a boundary partition wall 2*a* at the stage of the raw work-piece member forming so that the wall 2*a* divides the scroll passage 12 and forms the inner scroll passage 2 as well as the outer scroll passage 1. The insert member 60 comprising the cover and the radius-reducing plate part 62 is provided with a plurality of insert vanes 6*a* on the side of the cover 6, so that the insert vanes 6*a* are arranged along the boundary partition wall 2*a*.

Further, the insert vanes 6*a* form a part of the cover 6 so that the vanes protrude toward the exhaust side, substantially along the direction parallel to the rotation axis; the vanes are configured so as to control the exhaust gas stream. In addition, between each of the insert vanes 6*a*, an exhaust gas passage 6*b* is formed; a row of exhaust gas passages 6*b* is formed in a spiral direction around the rotation axis, as is the case with the raw of insert vanes 6*a*.

As shown in FIG. 1, toward an inner diameter side (inside of the insert vanes 6*a*) as to the cover 6 of the insert member 60, the radius-reducing plate part 62 is extended as a part of the insert member 60, thereby the radius-reducing plate part 62 and the cover 6 are integrated in one body; the radius-reducing plate part 62 is extended in a gap between the bearing housing 11 and the turbine rotor 10, along a plane vertical to the rotation axis of the turbine rotor 10.

The radius-reducing plate part 62 is provided so as to face the turbine rotor 10, and is used to shield the heat flux from the turbine rotor.

As described thus far, the insert member 60 that comprises the cover 6 and the radius-reducing plate part 62 and is made by precision casting in the stage of a raw work-piece forming; surface machining is performed as to the inner periphery surface (Diameter D1) of the ringed protrusion part 7 in the cover 6 in a machining process.

Further, an outer periphery step-surface 11*a* of the bearing housing 11 is fitted into the machined surface 7*e* of the inner periphery of the circle ringed protrusion 7 so that the bearing housing 11 supports the insert member 60. In other words, by adding surface machining on the inner periphery surface (Diameter D1) of the ringed protrusion 7 of the cover 6, a surface with high accuracy (dimension accuracy) is obtained; thus, the fitting accuracy as to the inner periphery surface (Diameter D1) and the outer periphery step-surface 11*a* of the bearing housing 11 is enhanced (see FIG. 1).

In the manner as described, surface machining is performed on both the inner periphery surface (Diameter D1) of the ringed protrusion 7 and the outer periphery step-surface 11*a* of the bearing housing 11, thereby the ringed protrusion part 7 being arranged between the inner side (the small radius side) of the cover 6 and the radius-reducing plate part 62; thus, both the surfaces (contact surfaces as to the ringed protrusion part 7 and the bearing housing 11) are fitted each other with high accuracy and without misalignment.

On the other hand, according to the conventional approach as depicted in FIG. 5 whereby the cover 6 is sandwiched by the turbine housing 01 and the bearing housing 11, in the neighborhood part of the outer periphery part as to the cover 6, in other words, in the neighborhood of the circular periphery 8 of the cover 6; thereby, a plurality of bolts 29 fastens the bearing housing 11 toward the turbine housing 01. Hence, the fitting of the cover in the present embodiment can be performed with higher accuracy in comparison with the fitting in the conventional approach.

In the next place, as shown in FIG. 2(A), an outer periphery surface 6*u* that is an outer circumferential (circle) surface of the cover 6 is machined; an area (a convex part 8*a*) of the cover in the neighborhood of the outer periphery surface 6*u* is sandwiched between the bearing housing 11 and the turbine housing 01 that support the cover 6; and, the radius-reducing plate part 62 is extended, in a gap between the turbine housing and the bearing housing, toward the rotation axis, without an inner side (the rotation axis side) constraint condition (namely, under a free condition without deformation constraint).

Further, on a side surface of the cover 6 opposite to the side surface where the insert vanes are provided to, a plurality of ribs 69 is provided in radial directions. It is noted that the radius-reducing plate part 62 is not provided with ribs, and is formed as a thin disk so as to play the role of a heat insulation plate.

According to the configuration as described above, the outer periphery surface 6*u* that is an outer circumferential (circle) surface of the cover 6 is machined when (or after) the insert member is manufactured as a raw work-piece member; the area in the neighborhood of the outer periphery surface 6*u* is sandwiched between the bearing housing 11 and the turbine housing 01 that support the cover 6; the radius-reducing plate part (a heat insulation plate) 62 that is exposed to a high temperature condition is extended, in a gap between the turbine housing and the bearing housing, toward the rotation axis, without an inner side (the rotation axis side) constraint condition (under a free condition without deformation constraint). Thus, the thermal expansion of the radius-reducing plate part (a heat insulation plate) 62 becomes permissible so that thermal stress due to thermal deformation constraint is prevented. Consequently, the radius-reducing plate part (a heat insulation plate) 62 can be prevented from being broken by the thermal stress.

Next, as shown in FIGS. 3(A) and 3(B), a tongue 5 is provided at the exhaust gas inlet part of the inner scroll passage 2. The tongue 5 which is formed in the raw work-piece forming stage, is arranged along the exhaust gas stream to guide the exhaust gas to smoothly flow into the inner scroll passage 2.

Hence, in the embodiment like this, as shown in FIG. 3(B), the raw work-piece surface 6*s* of the cover 6 is provided with a protrusion part 19*s* (of the thickness t in the raw work-piece forming stage) that protrudes from the raw work-piece surface 6*s* of the cover 6, in relation to the tongue 5 of the turbine housing 01.

The protrusion part 19*s* is machined so that a clearance S is formed between the tongue 5 and the protrusion part 19*s*, before the cover 6 is installed into the exhaust gas turbine.

According to the configuration as described, as shown in FIG. 3(B), the protrusion part 19*s* is machined to form a finished surface 19; thus, the clearance S between the finished surface 19 and the tip part of the tongue 5 can be always a minimum level in relation to the dimension of the tongue 5.

Accordingly, the optimally minimum limit dimension as to the clearance S between the finished surface 19 and the tongue 5 can be adopted, due to the machining process. Thus, the gas leakage through the clearance S can be reduced, and the efficiency of the gas turbine can be enhanced.

Further, as for the cover 6, only a part of the raw work-piece surface is protruded so as to form the protrusion part 19*s* which is only the machined part. Thus, the manufacturing and the assemble structure become simple and cost-effective.

In the next place, according to the embodiment of the present invention, an explanation is now given in relation to the assembling of the described structural members.

As shown in FIG. 1, the cover 6 of the insert member 60 is sandwiched between the turbine housing 01 and the bearing housing 11; thereby, a plurality of the bolts 29 fasten the bearing housing 11 to the turbine housing 01, and the cover 6 is positioned by the aid of a locking pin 30.

In addition, as shown in FIG. 2(A), a ring circle 8 forms an inner circular periphery of an inner diameter $D_2$ as to the turbine housing 01. Further, the inner circular periphery forms a concave part is of the turbine housing 01; a convex part 8*a* that is formed around the outer periphery of the cover 6 is fitted into the concave supporting part 1*s* (cf. FIG. 1).

In addition, as is the case with the conventional approach of FIG. 4, a control valve 4 is provided to the exhaust gas inlet side of the outer scroll 1 so as to control the exhaust gas flow rates into the inner scroll passage 2 as well as into the outer scroll passage 1, in a manner that the control valve 4 comes in contact with a periphery wall 4*a* as well as leaves the periphery wall 4*a*, the periphery wall 4*a* being formed in the turbine housing 01.

In other words, the control valve 4 comes into contact with the periphery wall 4*a* during the engine low-speed operation so that the outer scroll passage 1 is closed; thus, the engine exhaust gas flows only into the inner scroll passage 2 along the direction of a curved arrow $U_2$ (cf. FIGS. 2(A) and 4(A)). On the other hand, the control valve 4 leaves the periphery wall 4*a* during the engine high-speed operation so that the outer scroll passage 1 is opened; thus, the engine exhaust gas flows not only into the inner scroll passage 2 along the direction of the curved arrow $U_2$ but also into the outer scroll passage 1 along the direction of a curved arrow $U_1$ (cf. FIGS. 2(A) and 4(A)). Further, the exhaust gas that flows into the outer scroll 1 flows into the inner scroll passage 2 through the exhaust gas passages 6*b* between the insert vanes 6*a* thereof.

Thus, the exhaust gas flow rate can be changed from the engine low-speed speed operation to the engine high-speed operation, and vice versa, by controlling the control valve 4.

INDUSTRIAL APPLICABILITY

The present invention can provide a manufacturing method for manufacturing a variable capacity exhaust gas turbine, the gas turbine comprising a configuration member that is manufactured through a process of raw work-piece forming such as casting and a subsequent process of finished machining, whereby the clearance around the tongue for making the exhaust gas smoothly stream can be formed so as to be restrained to a minimal level, and the cover can be in stalled in the exhaust gas turbine so as to be fitted in the neighborhood of the ring protrusion part of the cover, with higher accuracy.

The invention claimed is:

1. A manufacturing method for manufacturing a variable capacity exhaust gas turbine, the gas turbine comprising:

a turbine shaft supported by a bearing housing;

a turbine rotor that is fixed to an end of the turbine shaft and rotationally driven by exhaust gas;

an exhaust gas inlet through which the exhaust gas is supplied;

an exhaust gas outlet through which the exhaust gas is discharged; and a turbine housing comprising:

a scroll passage between said exhaust gas inlet and said turbine rotor, the cross-section area of the scroll passage gradually reduces along the direction of the exhaust gas stream, the scroll passage is provided with an inner scroll passage and an outer scroll passage into which the scroll passage is divided along a hoop direction around the turbine rotor, a plurality of insert vanes being provided in a row along the boundary between the inner scroll passage and the outer scroll passage, the row of insert vanes being configured so that the exhaust gas flow directly into the inner scroll passage and the exhaust gas flow into the inner scroll passage via the outer scroll passage are controlled, and a control valve that is arranged at an exhaust gas inlet side as to the outer scroll passage so as to control the exhaust gas flow rate into the inner scroll passage as well as into the outer scroll passage, and an opening end face that faces the bearing housing;

the gas turbine further comprising:

a cover that is arranged at the opening end face of the turbine housing so as to demarcate the inner scroll passage and the outer scroll passage, the insert vanes being provide so as to protrude from the body of the cover toward the side of the exhaust gas passage;

wherein, a radius-reducing plate part is extended so as to form an integrated part together with the cover, the cover and the radius-reducing plate part being arranged in a gap between the bearing housing and the turbine rotor, along a plane vertical to the rotation axis of the turbine rotor;

the cover and the radius-reducing plate part are formed as an integrated member by means of any one of casting, injection molding, or cold forging;

a raw work-piece surface of the cover is provided with a protrusion part in a raw work-piece manufacturing stage so that the protrusion part protrudes from the raw work-piece surface of the cover to a direction near a tongue that is formed in the exhaust gas inlet of the inner scroll passage in the turbine housing as a part thereof, the protrusion part arranged to face the tongue;

the integrated member as to the cover and the radius-reducing plate part is assembled into the gas turbine after the protrusion part is machined so that an allowable clearance is formed between the tongue and the protrusion part.

2. The manufacturing method for manufacturing a variable capacity exhaust gas turbine as per claim 1, whereby the integrated member as to the cover and the radius-reducing plate part comprises a connection part between the cover and the radius-reducing plate part, the connection part is provided with a circle ringed protrusion toward the bearing housing, the circle ringed protrusion being formed so that the circle ringed protrusion and the integrated member as to the cover and the radius-reducing plate part form an integrated body in and from the stage of raw work-piece forming;

the inner periphery of the circle ringed protrusion is machined in a machining process following to the raw work-piece forming process, so that an outer circle periphery step-surface of the bearing housing is fitted into the inner periphery of the circle ringed protrusion in the stage of the assembling process of the gas turbine, in order that the integrated member as to the cover, the radius-reducing plate part and the connection part is supported by from the bearing housing.

3. The manufacturing method for manufacturing a variable capacity exhaust gas turbine as per claim 2, whereby an outer periphery surface that is an outer circumferential circle surface of the cover is machined;

a convex part that is formed around the outer periphery of the cover, in an adjacent neighborhood of the outer periphery surface, thereby convex part sandwiched between the bearing housing and the turbine housing so that the bearing housing and the turbine housing support the cover;

the radius-reducing plate part that is extended from the cover in a gap between the turbine housing and the bearing housing toward the rotation axis of the turbine rotor is placed under a free condition without deformation constraint, so that the thermal expansion of the radius-reducing plate becomes allowable.

* * * * *